US010655254B2

(12) United States Patent
Dealey et al.

(10) Patent No.: US 10,655,254 B2
(45) Date of Patent: May 19, 2020

(54) KNITTING MACHINE WITH ELECTRONIC AUXILIARY COMPONENT

(71) Applicant: NIKE, Inc., Beaverton, OR (US)

(72) Inventors: Stuart W. Dealey, Portland, OR (US); Adrian Meir, Portland, OR (US); Gagandeep Singh, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 124 days.

(21) Appl. No.: 15/941,577

(22) Filed: Mar. 30, 2018

(65) Prior Publication Data

US 2018/0282915 A1 Oct. 4, 2018

Related U.S. Application Data

(60) Provisional application No. 62/479,698, filed on Mar. 31, 2017.

(51) Int. Cl.
*D04B 35/18* (2006.01)
*D04B 15/70* (2006.01)

(52) U.S. Cl.
CPC ..... *D04B 35/18* (2013.01); *D04B 15/70* (2013.01)

(58) Field of Classification Search
CPC ..... D04B 15/70; D04B 15/78; D04B 15/665; D04B 35/10; D04B 35/18
USPC ..... 66/165, 163
See application file for complete search history.

(56) References Cited

U.S. PATENT DOCUMENTS 3,529,445 A * 9/1970 Brose ..... D04B 35/18 66/157
3,904,529 A * 9/1975 Jacob ..... D04B 35/18 250/559.4
3,937,038 A * 2/1976 Sick ..... D04B 35/18 66/157
4,027,982 A * 6/1977 Ohishi ..... D04B 35/18 356/237.1
4,711,101 A * 12/1987 Goller ..... D04B 37/02 66/64
5,014,524 A * 5/1991 Smilovici ..... D04B 15/96 66/60 H
5,511,392 A * 4/1996 Sawazaki ..... D04B 9/065 66/54
5,524,460 A * 6/1996 Michetti ..... D04B 35/18 250/559.29
5,912,816 A * 6/1999 Emery ..... D04B 37/06 700/141
6,035,669 A * 3/2000 Gutschmit ..... D04B 35/18 66/157

(Continued)

FOREIGN PATENT DOCUMENTS

CN 1756865 A 4/2006
CN 101835930 A 9/2010
EP 2228475 A1 9/2010

OTHER PUBLICATIONS

Office Action dated Sep. 3, 2019 for Taiwan Application No. 107111505, 25 pages.

*Primary Examiner* — Danny Worrell
(74) *Attorney, Agent, or Firm* — Brinks Gilson & Lione

(57) ABSTRACT

A knitting machine may include a needle bed and a carriage that is movable along the needle bed. The carriage may be configured to engage at least one feeder to move a dispensing area of the feeder along the needle bed while dispensing a yarn, where the carriage includes an interface for providing power to an auxiliary component.

17 Claims, 6 Drawing Sheets

(56) References Cited

U.S. PATENT DOCUMENTS

| | | | | |
|---|---|---|---|---|
| 6,112,557 | A * | 9/2000 | Crabtree | D04B 35/10<br>66/125 R |
| 6,244,076 | B1 * | 6/2001 | Ganor | D04B 35/18<br>66/60 R |
| 6,318,132 | B1 * | 11/2001 | Gutschmit | D04B 35/18<br>66/123 |
| 6,691,534 | B1 * | 2/2004 | Schonauer | D04B 35/18<br>66/157 |
| 7,509,821 | B1 * | 3/2009 | Lin | D04B 35/12<br>66/125 R |
| 2001/0004839 | A1 * | 6/2001 | Ganor | D04B 35/18<br>66/111 |
| 2006/0156762 | A1 | 7/2006 | Nakamori | |

* cited by examiner

KNITTING MACHINE WITH ELECTRONIC AUXILIARY COMPONENT

RELATED APPLICATIONS

This application claims the benefit of U.S. Provisional Application No. 62/479,698, filed Mar. 31, 2017, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, the wales and courses run roughly parallel.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

One common problem with existing knitting machines is the inability to detect broken needles. When a needle breaks, it can interrupt the knit structure of a knitted component, which often requires the knitted component to be discarded as scrap. This problem may go undetected for extended periods of time, especially when the knitting machine is operating automatically without continuous human oversight.

DETAILED DESCRIPTION

Figure 1:
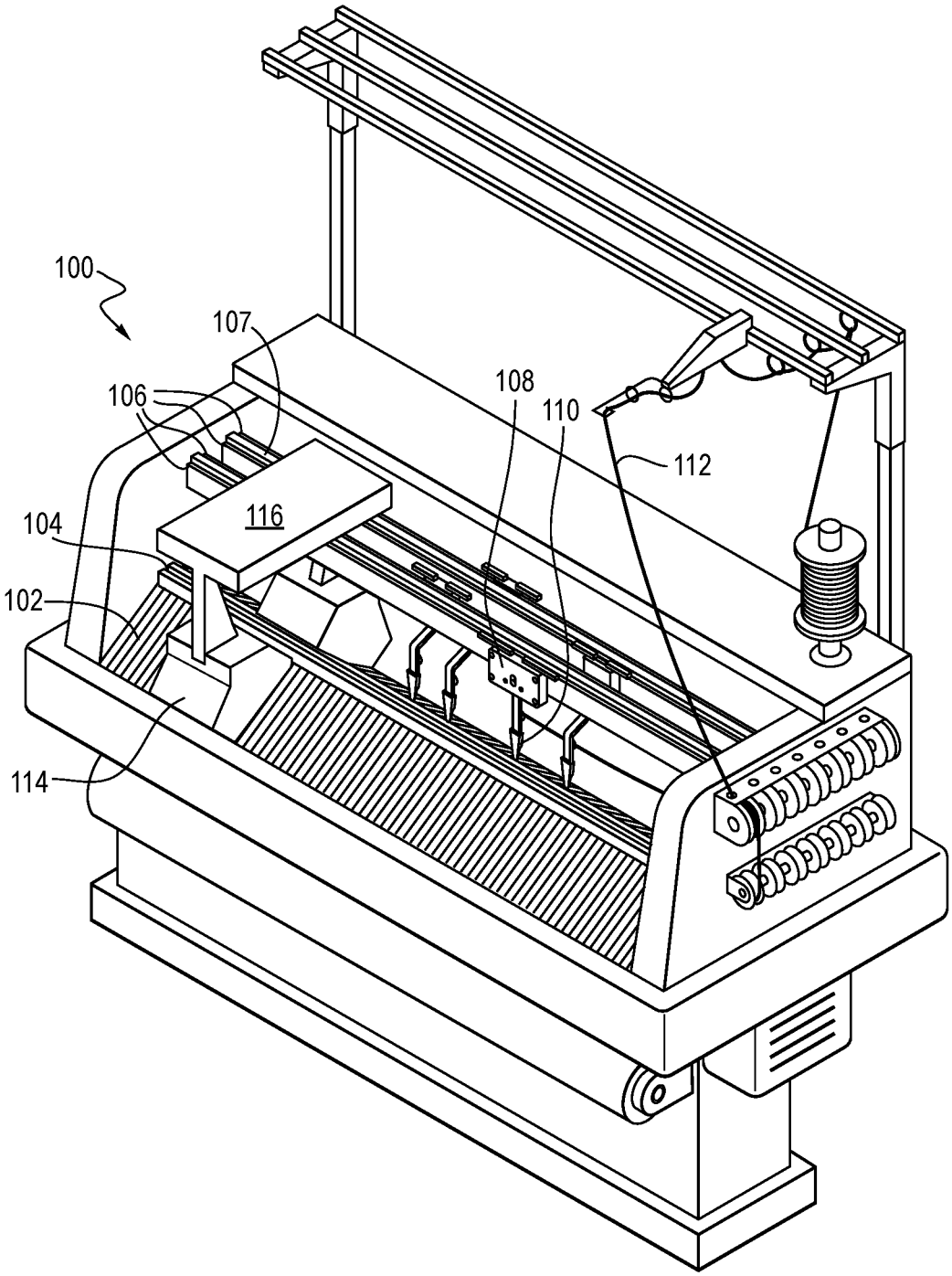
FIG. 1 is an illustration showing a knitting machine in accordance with the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

FIG. 1 shows a knitting machine 100 with two needle beds (a front or first needle bed 102 and a back or second needle bed 104) that are angled with respect to each other (e.g., thereby forming a V-bed). The needles of the first needle bed 102 may lay on a first plane, and the needles of the second needle bed 104 may lay on a second plane. The first plane and the second plane may be angled relative to each other and meet to form an intersection (or axis) that extends along a majority of a width of the knitting machine 100. The needles each may have a first or neutral position where they are retracted and a second or extended position where they are extended. In the neutral position, an end of the needles is spaced from the intersection, and in the extended position, the needles pass through the intersection. The needles, needle beds, and intersection are described in additional detail in U.S. patent application Ser. No. 13/048,540, patented as U.S. Pat. No. 9,060,570, which is herein incorporated by reference in its entirety.

One or more rails 106 may extend above and parallel to the intersection and may provide attachment points for one or more feeders 108. Herein, the rails 106 are defined by a track for which a feeder 108 may couple to in a movable manner. The rails 106 may be secured to a body 107, where the body 107 includes a rail 106 on each side (e.g., on two sides as shown) (and where each of the rails 106 are configured to couple to a different feeder 108). Two rails 106 are included in the depicted embodiment, but more or fewer than two rails 106 may be included. The feeders 108 may include a dispensing area 110 located near the intersection and configured to dispense a yarn 112 to at least one of the first needle bed 102 and the second needle bed 104 as it moves along the intersection.

The knitting machine 100 may include a carriage 114 (with includes an upper portion 115 for communication with the feeders 110 a lower portion 114 (also called a cam box) for communication with cams beneath the needle beds 102 that is movable along the first needle bed 102 and the second needle bed 104. An upper portion 116 of the carriage 114 may include a set of plungers (not shown) that can selectively engage at least one of the feeders 108 such that the feeder 108 that is engaged moves along one of the rails 108 as the carriage 114 moves. As the carriage 114 moves along the first needle bed 102 and the second needle bed 104, the carriage 114 may selectively actuate needles of the first needle bed 102 and/or the second needle bed 104 such that the actuated needles move from the default position to the extended position. The actuation may be the result of a set of cams (not shown in FIG. 1) of the carriage 114 making contact with a butt portion of the needles and forcing the needles to move from the default position to the extended position as the carriage 114 passes. Due to the action of the carriage 114, the feeder 108, and the needles, the yarn 112 may be dispensed from the feeder 108 and to the needles of at least one of the first needle bed 102 and the second needle bed 104.

Figure 2:
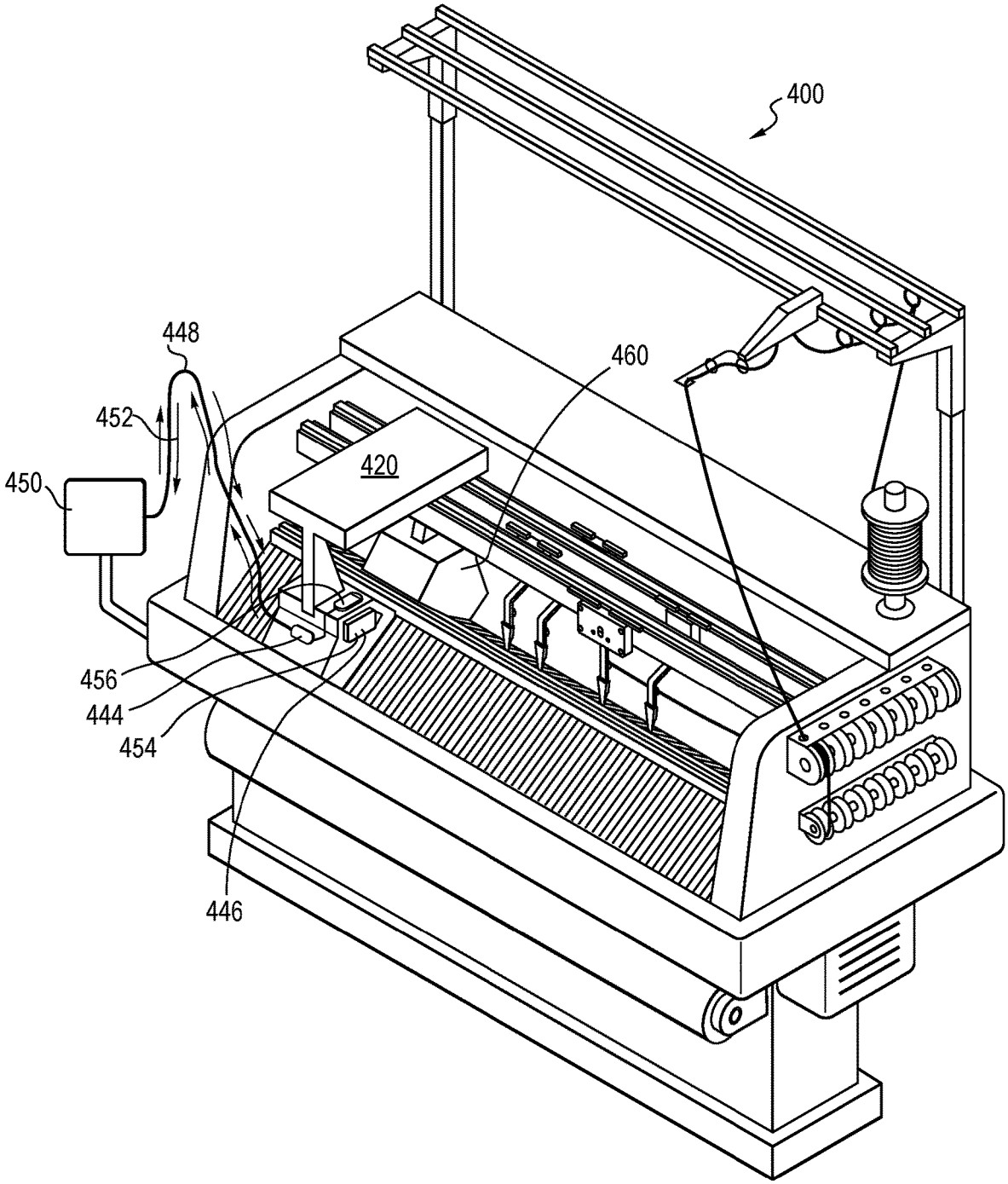
FIG. 2 is an illustration showing a knitting machine with an auxiliary component in accordance with the present disclosure.

Referring to FIG. 2, in some embodiments, a carriage 420 of a knitting machine 400 (and potentially multiple carriages) may include an interface 444 for providing power to at least one auxiliary component 446. The auxiliary component 446 may be selectable from a variety of auxiliary components that can interact with the interface 444. For example, the auxiliary component may include a light, a camera, a sensor, a cutting device, or any other suitable auxiliary component. The interface may be any suitable type of interface, including (but not limited to) a USB port, a standard power receptacle (such as a receptacle compatible with a NEMA-1 or NEMA-5 connector in North America and the equivalent in other locations, for example), a parallel port (e.g., a DB-25 port), and a serial port (e.g., a DE-9 port). Advantageously, the auxiliary component 446 may be coupled to the carriage 420 such that it moves along a needle bed with the carriage and is thereby continuously near the knitting action (e.g., the looping of yarns on the needles), which may provide the ability of the auxiliary component 446 to perform operations that affect the yarn just before, during, or after it is looped on a needle, to collect information about the knitting process, the yarn, or the knitting machine and relay that information to the knitting machine and/or a user, etc. When the interface 444 provides power (e.g., in the form of electricity), the power may be provided to the carriage 420 by extending a cable 448 to the carriage 420 from a location (e.g., a location that is static with respect to the frame) via a cable 448, wirelessly, or by another suitable device or method. While not shown, it is contemplated that the knitting machine 400 may include a cable management device to manage slack in the cable as the carriage 420 moves.

In some embodiments, the interface 444 may be capable of unilateral or bilateral communication between the auxiliary component 446 and a control system 450 of the knitting machine (or another control system). When bilateral communication is provided by the interface 444, the knitting machine may receive a feedback signal 452 from the auxiliary component 446 (e.g., such that the feedback signal 452 is received by the control system 450 of the knitting machine 400). The knitting machine 400 may adjust its operation in response to the feedback signal 452. For example, the knitting machine 400 may adjust a knitting sequence in response to the feedback signal 452 to account for certain conditions, such as particular environmental conditions, machine damage, yarn breakages, etc. In some embodiments, the knitting machine may be capable of terminating a knitting process in response to the feedback signal 452 (e.g., when the feedback signal 452 indicates a broken needle discovered by the auxiliary component 446).

The auxiliary component may be a sensor configured to sense at least one environmental condition. For example, the auxiliary component may include a temperature sensor 454 and/or a barometer 456. This may be advantageous for providing information to the control system 450 such that the control system 450 can take the environmental conditions into account by modifying certain characteristics of the knitting process (e.g., knitting speed, yarn tension, etc.). The result may be a safer, more efficient, and more effective knitting process.

Figure 3:
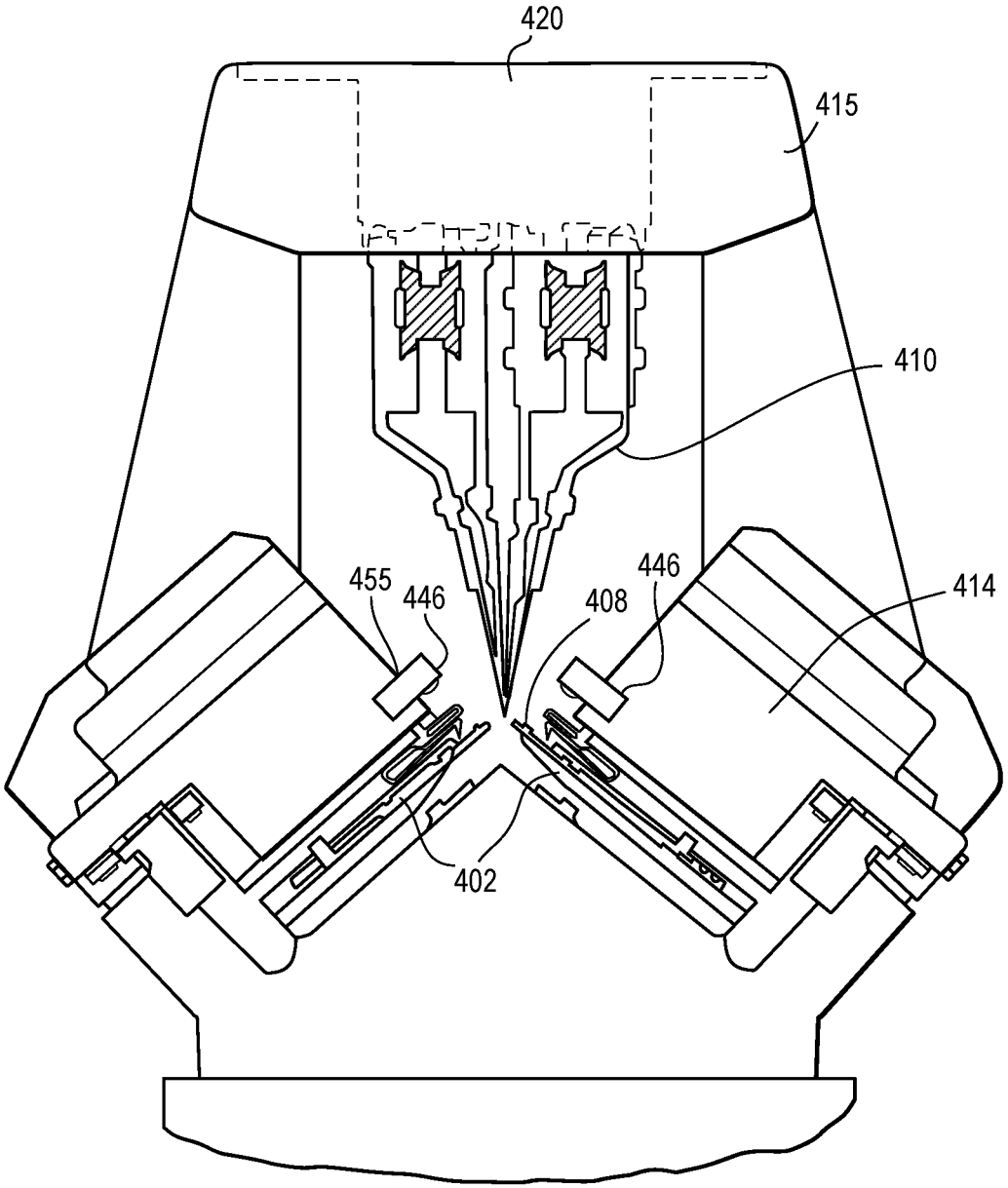
FIG. 3 is an illustration showing a side view of the knitting machine of FIG. 2 having a carriage with the auxiliary component in accordance with the present disclosure.

A side view of the carriage 420, as well as two needle beds 402, are shown in FIG. 3. As shown, the carriage 420 may include an upper portion 415 for cooperating with a set of feeders 410 and a lower portion with a cam box 414. The cam box 414 may run along the needles 403 of the needle beds 402. As shown, the auxiliary component 446 may include a sensor 455 which is configured to detect a displaced or broken needle 403. The sensor 455 may be a laser sensor, a camera, a metal detector, or any other suitable sensor device.

Figure 4:
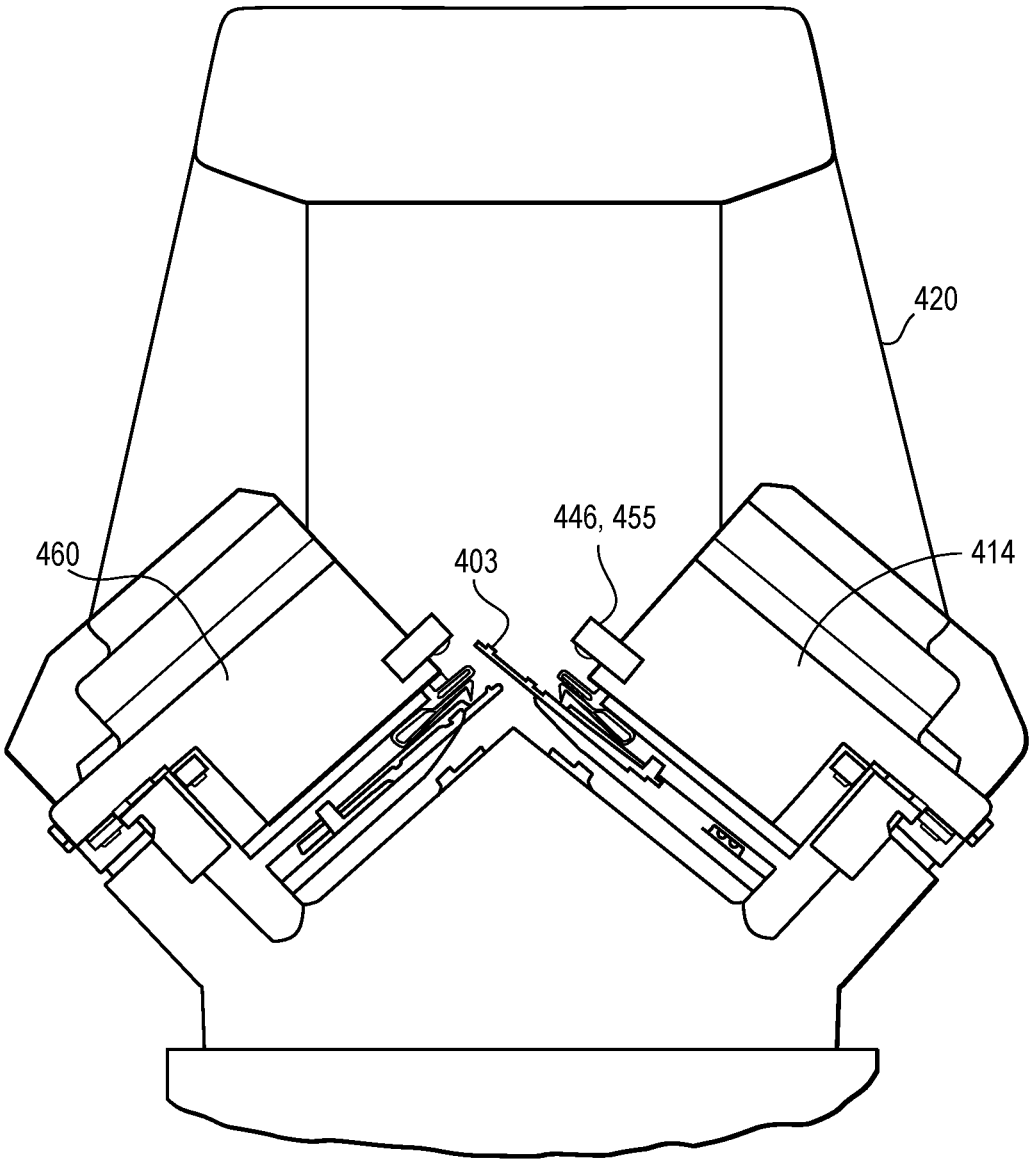
FIG. 4 is an illustration showing side view of the knitting machine of FIG. 3 and having a needle stuck in an actuated position.

FIG. 4 shows the knitting machine of FIG. 3, where a needle is stuck in the "up" or actuated position. When this occurs, the loops or other knit structure of a knitted component formed on the knitting machine may be compromised since the needle 403 is not operating properly, which may result in the knitted component being discarded as scrap. More seriously, the carriage 420 and/or the feeder 410 (FIG. 3) may contact the needle 403 during the knitting process, which may damage the knitting machine and require maintenance (e.g., replacement of the needle, which is associated with significant machine downtime). In other circumstances, the needles 403 may break (e.g., due to wear), which may also interrupt the knitting process and/or require the knitted component to be discarded.

The sensor 455, which may be a laser sensor, camera, etc., may be located on an end of the cam box 414, and configured to detect when the needle is stuck in the actuated position. Locating the sensor 455 at the end 460 (see also FIG. 2) of the cam box 414 may be advantageous since the needles 403 may be located in the "down" or unactuated position when the end 460 passes over those needles 403 when the knitting machine is working properly (i.e., since they are typically only actuated into the "up" position when near the center if the cam box 414 due to the placement of the cams). Thus, the sensor may operate by viewing (e.g., with a laser or camera) or otherwise sensing (e.g., through metal detection) the presence of the needle 403 in the "up" position as the end 460 of the cam box 414 passes over the needle 403. Once the needle 403 is detected in an improper location, the sensor 455 may electronically send a signal to the control system 450 (FIG. 2), and the control system 450 (FIG. 2) may appropriately respond (e.g., by shutting down the knitting operation, indicating a potential issue to the operator through the interface 450, etc.).

The sensor 455 may additionally or alternatively be configured to detect the presence of a broken or missing needle. For example, in some embodiments, the sensor 455 may be located at a location of the cam box 414 where the needles properly extend to the "up" or actuation position to cooperate a feeder (e.g., near the center of the cam box 414), and thus the lack of a sensor signal corresponding to a needle 403 may indicate a problem with the needle 403 when the needle is supposed to be actuated. The control system 450 (FIG. 2) may then react appropriately to prevent or control damage to the knitted component and/or the knitting machine.

Figure 5:
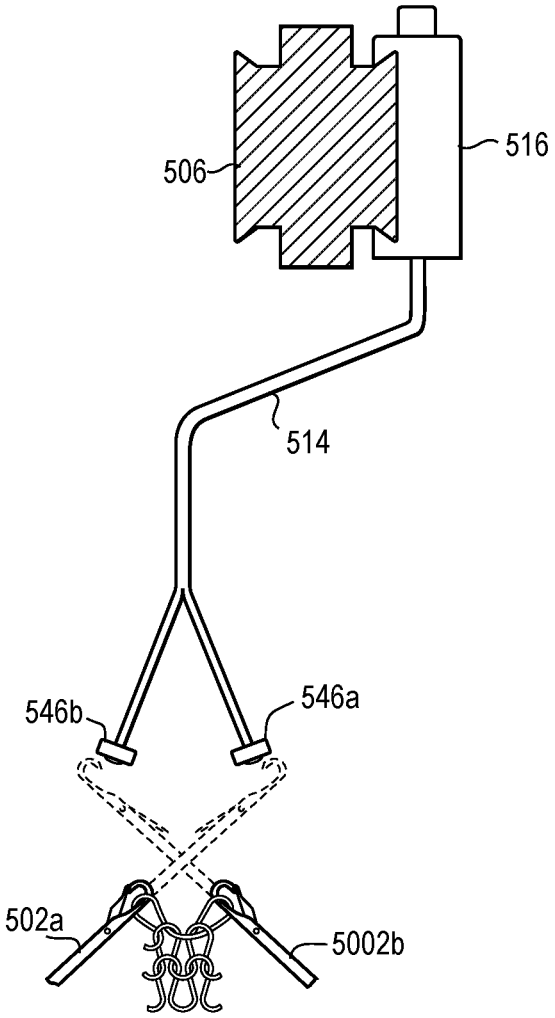
FIG. 5 is an illustration showing an auxiliary transport device with two auxiliary components in accordance with the present disclosure.
Figure 6:
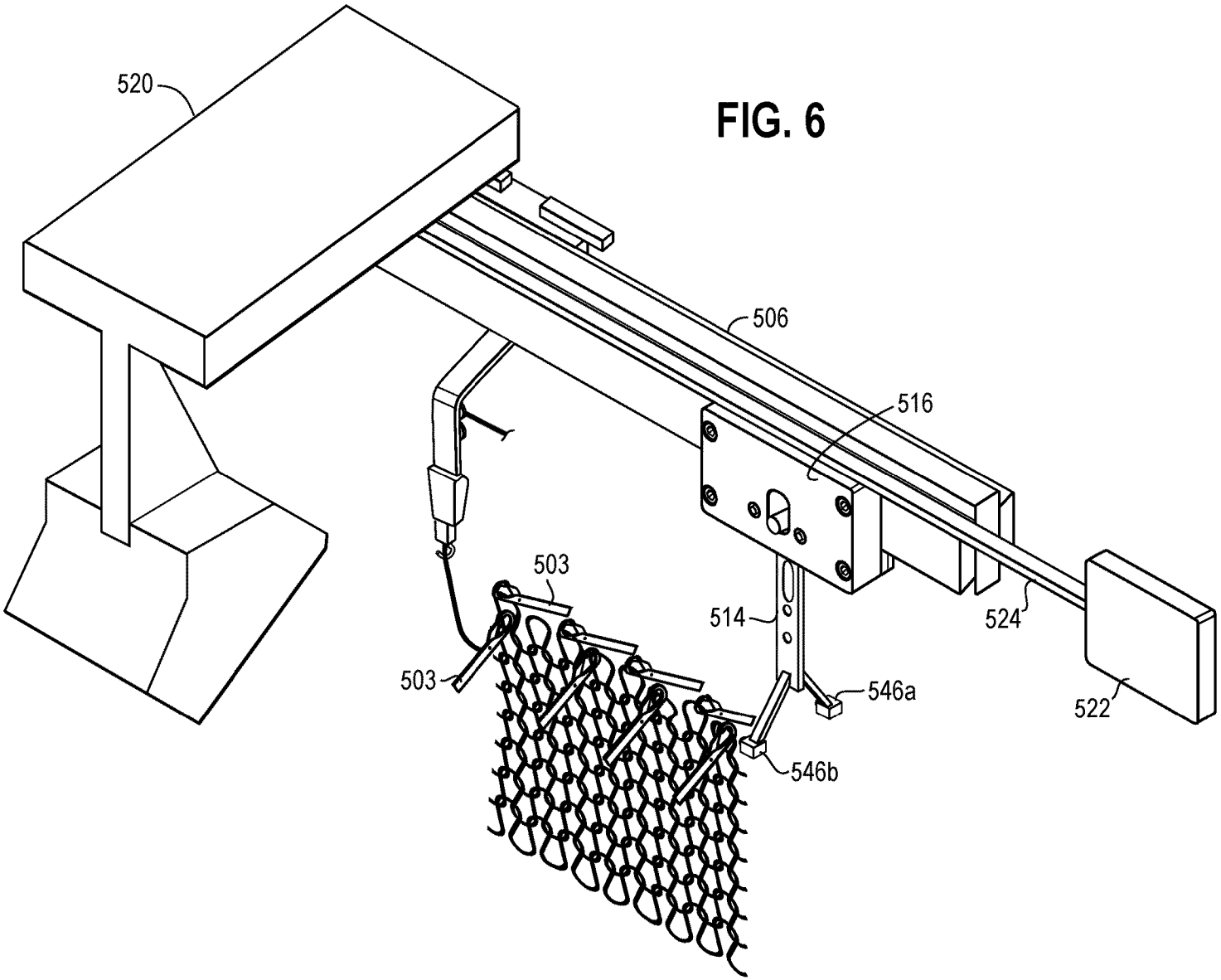
FIG. 6 is an illustration showing a perspective view of the auxiliary transport device of FIG. 5 on a rail of a knitting machine and operated via a belt drive in accordance with the present disclosure.

In some embodiments, a separate auxiliary transport device 514 may house and transport the auxiliary component 546 rather than the carriage (or, the carriage may include an auxiliary component while the auxiliary transport device 514 includes a different auxiliary component), as shown in FIG. 5. Referring to FIG. 5, the auxiliary component 546 may be an electronic device and may include any of the features described with respect to the auxiliary components above, may be included on an auxiliary transport device 514 with an upper portion 516 coupled to a rail 506 of the knitting machine. While not shown, the auxiliary transport device 514 may be wired to a control system, a stationary user interface, etc. in a manner similar to the wiring of the above-described carriage with the auxiliary component 446 (FIG. 2). In the depicted embodiment, a first auxiliary component 546*a* is associated with the first needle bed 502*a*, and a second auxiliary component 546*b* is associated with a second needle bed 502*b* (and it is noted that the dashed lines indicate the "up" or actuated position of the needles). Each of the first auxiliary component 546*a* and the second auxiliary component 546*b* may include a sensor (e.g., a laser, camera, metal detector, or any other suitable sensor) for monitoring the operation and health of the needles 503. For example, the auxiliary transport device 514 may run back and forth along the rail 506 such that the first auxiliary component 546*a* and the second auxiliary component 546*b* run back and forth along the needle beds 502 to view or otherwise detect the health of the needles 503. This may occur continuously during knitting, upon predetermined time intervals, and/or upon a predetermined number of carriage passes. While not shown, in other embodiments, the auxiliary transport device 514 may additionally or alternatively include other auxiliary components, such as a temperature sensor, a barometer, etc. that collect and relay information about the yarn and/or loops of the knitted component, and/or the atmospheric conditions. Also, like the auxiliary component 446 described above (see FIG. 2), the auxiliary components 546*a* and 564*b* may be coupled to a control system (such as the control system 450 of FIG. 2), and may provide feedback for determining operating parameters of the knitting machine. The auxiliary components 502*a* and/or 502*b* may additionally or alternatively include devices other than sensors for performing a function during manufacturing of the knitted component, such as a cutting device, moisture or adhesive-application device, a heating device, etc. While not shown, the auxiliary transport device 514 may include a port (like the port or interface 444 of FIG. 2 such that different auxiliary components can be selectively used with the auxiliary transport device 514.

FIG. 5 shows a perspective view of the auxiliary transport device 514 of FIG. 4 having the auxiliary components 546*a* and 546*b*. The upper portion 516 of the auxiliary transport device 514 may have wheels and/or other suitable devices for moving the auxiliary transport device 514 along the rail 506. While the auxiliary transport device 514 may be configured to be moved with the carriage 520 (i.e., in a manner similar to a feeder), it is also contemplated that the auxiliary transport device 514 may be actuated independently from the carriage 520.

The auxiliary transport device 514 may be coupled to an actuator 522 configured to move the auxiliary transport device 514 such that the auxiliary components 546*a* and 546*b* move along the needle beds of the knitting machine, and/or along loops of the knitted component, as shown. The auxiliary transport device 514 is preferably movable independently of the carriage 520 (i.e., due to actuation of the actuator 522), but in other embodiments, it may instead (or additionally) be actuated by the carriage 520 (e.g., in a manner similar to actuation of a knitting feeder 208 of FIG. 1). For example, the auxiliary transport device 514 may be coupled to the actuator 522 via a belt 524 (which may be embodied as a chain, a flexible band, a conveyor, or another suitable device coupling the actuator with the auxiliary transport device 514). The location of the auxiliary components 546*a* and 546*b* may be selected such that they do not interfere with the needles 503 or the carriage 520 during knitting (e.g., they may be located above the needles 503 even when the needles are fully extended such that they cannot contact the needles 503 when they pass over the needles 503). Optionally, the upper portion 516 of the auxiliary transport device 514 may be given its own rail 506 such that it can operate without getting in the way of a knitting feeder 510, but in other embodiments, the upper portion 516 may share a rail 506 with another component (e.g., another auxiliary transport device 514 with additional auxiliary components, a knitting feeder, etc.).

Advantageously, by including the independently-movable and independently-controllable auxiliary transport device 514, the knitting machine may substantially increase its flexibility with respect to certain features since the movement of the auxiliary transport device 514 is not dependent on the position/movement of the carriage 520 (which also typically has the task of moving the knitting feeders). For example, the actuator 522 may move the auxiliary transport device 514 along the needles 503 without considering operation of the carriage 520 and the knitting feeders 510 to provide continuous information regarding the needles 503, environmental conditions, loops of the knitted component, etc. without being impacted by certain motions of the carriage 520 required for knitting certain structures.

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A knitting machine, the knitting machine comprising:

a first needle bed having a plurality of first needles and a second needle bed that is parallel to the first needle bed, the second needle bed having a plurality of second needles; and a carriage that is movable along the first needle bed and the second needle bed, the carriage configured to engage at least one feeder to move a dispensing area of the feeder along the first needle bed and the second needle bed while dispensing a yarn; and an auxiliary transport device that is movable along the first needle bed and the second needle bed, wherein the auxiliary transport device is independently movable relative to the carriage, and wherein the auxiliary transport device includes a first sensor and a second sensor, wherein the first sensor monitors the first needles and wherein the second sensor monitors the second needles.

2. The knitting machine of claim 1, wherein carriage includes an interface for providing power to an auxiliary component.

3. The knitting machine of claim 2, wherein a cable extends from a power supply to the carriage to provide the power to the interface.

4. The knitting machine of claim 1, wherein each of the first sensor and the second sensor is configured to determine when a needle is damaged or broken and then send a feedback signal to a control system of the knitting machine indicate that the needle is damaged or broken.

5. The knitting machine of claim 2, wherein the interface is configured to receive a feedback signal from the auxiliary transport device such that the feedback signal is received by a control system.

6. The knitting machine of claim 5, wherein the knitting machine is configured to adjust a knitting sequence in response to the feedback signal received by the control system.

7. The knitting machine of claim 5, wherein the knitting machine is configured to terminate a knitting process in response to a feedback signal received by the control system from the auxiliary transport device.

8. The knitting machine of claim 2, wherein the auxiliary component is a light.

9. The knitting machine of claim 2, wherein the auxiliary component is a sensor configured to sense at least one environmental condition.

10. The knitting machine of claim 9, wherein the auxiliary component is a temperature sensor.

11. A knitting machine, the knitting machine comprising:

a needle bed; and an auxiliary transport device, the auxiliary transport device configured to move along a rail of the knitting machine such that an end of the auxiliary transport device moves along a needle bed, wherein the end of the auxiliary transport device includes at least one electronic auxiliary component, wherein the auxiliary transport device includes a sensor configured to detect a needle of the needle bed, and wherein the auxiliary transport device is movable relative to a carriage of the knitting machine.

12. The knitting machine of claim 11, wherein the auxiliary transport device includes a second sensor configured to detect a needle of a second needle bed.

13. The knitting machine of claim 11, wherein a control system of the knitting machine is electrically connected to the auxiliary component and configured to receive a feedback signal from the auxiliary component.

14. The knitting machine of claim 11, wherein the end of the auxiliary transport device includes at least two electronic auxiliary components.

15. The knitting machine of claim 11, wherein the end of the auxiliary transport device includes a first electronic auxiliary component that moves along a first needle bed of the knitting machine and a second electronic auxiliary component that moves along a second needle bed of the knitting machine.

16. An auxiliary transport device for a knitting machine, the auxiliary transport device comprising:

an upper portion configured to couple to a rail of the knitting machine such that the auxiliary transport device is movable along a first needle bed and a second needle bed of the knitting machine, and such that the auxiliary transport device is movable relative to a carriage of the knitting machine; and a first sensor and a second sensor fixed to the upper portion, wherein the first sensor monitors needles of the first needle bed, and wherein the second sensor monitors needles of the second needle bed.

17. The auxiliary transport device of claim 16, wherein each of the first sensor and the second sensor is configured to determine when a needle is damaged or broken and then send a feedback signal to a control system of the knitting machine indicate that the needle is damaged or broken.

* * * * *